United States Patent [19]

Gadd et al.

[11] 3,931,788

[45] Jan. 13, 1976

[54] ADHESIVE EXTRUDING NOZZLE-GUIDANCE ARRANGEMENTS

[75] Inventors: Ronald O. C. Gadd, Leicester; Robert C. Quarmby, Groby; Frank R. Smith, Leicester, all of England

[73] Assignee: USM Corporation, Boston, Mass.

[22] Filed: Jan. 13, 1975

[21] Appl. No.: 540,411

[30] Foreign Application Priority Data

Jan. 31, 1974 United Kingdom ..... 4455/74

[52] U.S. Cl. ..... 118/8; 118/410; 118/411

[51] Int. Cl.[2] ..... B05C 3/02

[58] Field of Search ..... 118/7, 8, 410, 411

[56] References Cited

UNITED STATES PATENTS

| | | | |
|---|---|---|---|
| 2,014,472 | 9/1935 | French | 118/411 |
| 2,294,472 | 9/1942 | MacKenzie | 118/411 X |
| 2,730,735 | 1/1956 | Hannable et al. | 118/410 |
| 2,843,863 | 7/1958 | Weisz | 118/410 |
| 3,304,563 | 2/1967 | Fing | 118/410 |

*Primary Examiner*—Mervin Stein
*Assistant Examiner*—Steven Hawkins
*Attorney, Agent, or Firm*—Donald H. Halgren; Vincent A. White; Richard B. Megley

[57] ABSTRACT

A shoe machine having nozzles for applying adhesive progressively to the margin of a shoe bottom, in which the nozzles are moved heightwise to engage a guide of the nozzle with the edge of the shoe bottom maneuvered by an arrangement of piston and cylinder members, and a sensing device associated with a stop mechanism for control and guidance to enable the nozzles to follow the marginal contour of the shoe bottom to apply adhesive thereto, and thence to return the nozzles to their start position to begin another cycle.

7 Claims, 4 Drawing Figures

ADHESIVE EXTRUDING NOZZLE-GUIDANCE ARRANGEMENTS

BACKGROUND OF THE INVENTION

1. Field of the Invention

This invention is concerned with shoe manufacturing machines or with improvements in or relating to shoe upper conforming machines, that is, to machines for conforming portions of shoe uppers to the shapes of corresponding portions of appropriate lasts. The word shoe is used herein generically as indicating outer footwear generally, whether complete or during the course of manufacture.

2. Description of the Prior Art

Shoe upper conforming machines for performing lasting operations on side portions of shoes have been arranged to wipe marginal portions of the upper at opposite sides of a shoe assembly which comprises an upper and an insole mounted on a last or form. The shoe assembly may be wiped inwardly simultaneously at opposite sides of the shoe assembly across corresponding marginal portions of the insole so that the marginal portions of the upper and insole may become secured together by adhesive applying means with which the machine may be provided. Various arrangements have been proposed for wiping marginal portions of the upper, including band arrangements which wrap around the upper to wrap marginal portions of the upper over the insole, or wipers comprising a series of fingers movable widthwise with respect to the shoe assembly. Other arrangements include rotatable rolls which urge the marginal portions of the upper inwardly with respect to the marginal portions of the insole due to the action of helically disposed rib portions on the roll peripheries.

Various forms of adhesive applying devices have been proposed, including a pair of nozzle members which are adapted to apply adhesive simultaneously along marginal portions of the shoe bottom at opposite sides of the shoe assembly, the nozzle members being displaced widthwise, to follow the widthwise curvature of the side portions of the shoe bottom as determined by engagement of portions of the nozzle members with upstanding lasting marginal portions of the upper, by engagement with edges of the insole as shown in U.S. Pat. No. 3,399,411 and assigned to the assignee of the present invention, or by the engagement of template followers associated with the nozzle members with appropriately shaped templates supported in the machine.

Nozzles being guided by an upstanding upper margin present a problem in that the upper margin must be adequately supported against the outward forces applied by the nozzles. Such support often requires undue complexity of machine design and timing, is not particularly suited for progressive lasting, and requires a relatively long "open" time before the applied adhesive sets. A problem concerned with the use of templates is the requirement for selection and/or adjustment required for varying sizes and styles of shoes being lasted.

A copending U.S. patent application, Ser. No. 509,541, filed Sept. 26, 1974, discloses a nozzle guiding arrangement in which the nozzles follow the outline shape of the insole by engagement of guides, (which are associated with the nozzles), with the insoles. Sensors associated with each nozzle control excessive movement of the guides and maintain correct contact between the guides and the insole. Further lasting arrangements are shown in U.S. Pat. Nos. 3,359,536 and 3,758,904.

Accordingly, it is generally an object of the invention to improve upon the prior art with a relatively simple nozzle mounting means which is selfadjusting for a wide variety of shoe sizes and styles.

SUMMARY OF THE INVENTION

The invention provides, in accordance with one of its several features, means for applying adhesive prior to the operation of lasting instrumentalities. The adhesive applying means comprises a pair of nozzle members and means for bringing about relative movement, in a direction extending relatively lengthwise of the shoe assembly being operated upon, between the shoe supporting means and the nozzle members so that the nozzle members may apply adhesive along said marginal portions of the shoe bottom, the nozzle members being displaced (widthwise of the shoe assembly) during said relative movement in accordance with the width of successive portions of the shoe bottom. The nozzle members are initially caused to occupy inoperative positions close together but spaced heightwise away from the shoe bottom, means being provided for bringing about movement of the nozzle members from their inoperative positions heightwise toward the shoe bottom and outwardly away from each other to a limit determined by the operation of a stop means. The nozzle members are sufficiently spaced widthwise of the shoe assembly for guide portions associated with the nozzle members to move heightwise into positions to engage said opposite edge portions of the shoe bottom. The nozzle members are biased inwardly toward each other to maintain engagement between the guide portions of the nozzle members and said opposite edge portions of the shoe bottom during the relative movement between the nozzle members and the shoe support.

According to a further feature of the invention, there is provided a pneumatically operated piston and cylinder device which is arranged to move the nozzle members from their closely adjacent positions to their separated positions and a sensing device which is associated with said stop means for rendering said piston and cylinder device ineffective so that the nozzle members may be biased inwardly (by the action of suitable counterweights) to urge the guide portions of the nozzle members into engagement with said opposite edge portions of the shoe bottom. After engagement of the guide portions with the edge portions of the shoe bottom, the stop means is removed so as not to restrain the nozzle members against further separation as they operate along wider portions of the insole during the relative movement between the nozzle members and the shoe bottom.

Adhesive may be fed, in the form of solid rods, to melting devices associated with the nozzle members whereby molten adhesive is driven through outlet openings associated with the nozzle members. The nozzle members are also provided with needle valve arrangements for minimizing any tendency for drooling to occur between successive cycles of operation of the machine.

BRIEF DESCRIPTION OF THE DRAWINGS

The objects and advantages of the present invention will become more apparent when viewed with the accompanying drawings, in which.

DESCRIPTION OF THE PREFERRED EMBODIMENT

The present invention may be embodied in a shoe upper conforming machine such as that shown in U.S. application Ser. No. 459,693, filed Apr. 10, 1974. The machine described therein is adapted for simultaneously lasting opposite side portions of shoes which comprises an arrangement of shoe supporting means, shoe length sensing means, shoe positioning and clamping means, and a pair of lasting rolls.

Figure 1:
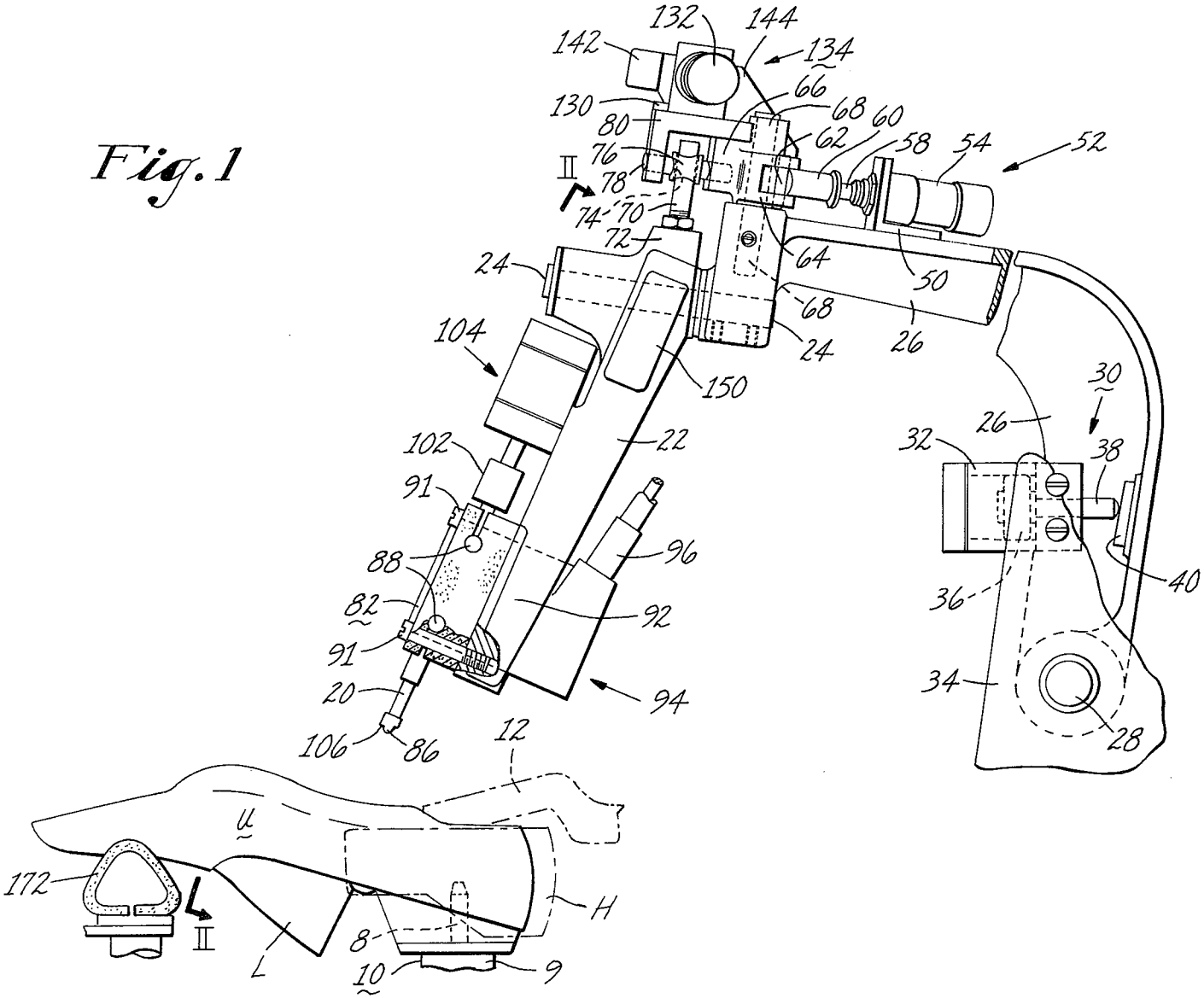
FIG. 1 is a right hand side elevational view of one of a pair of nozzle members, and of supporting means therefor, constructed in accordance with the present invention.
Figure 4:
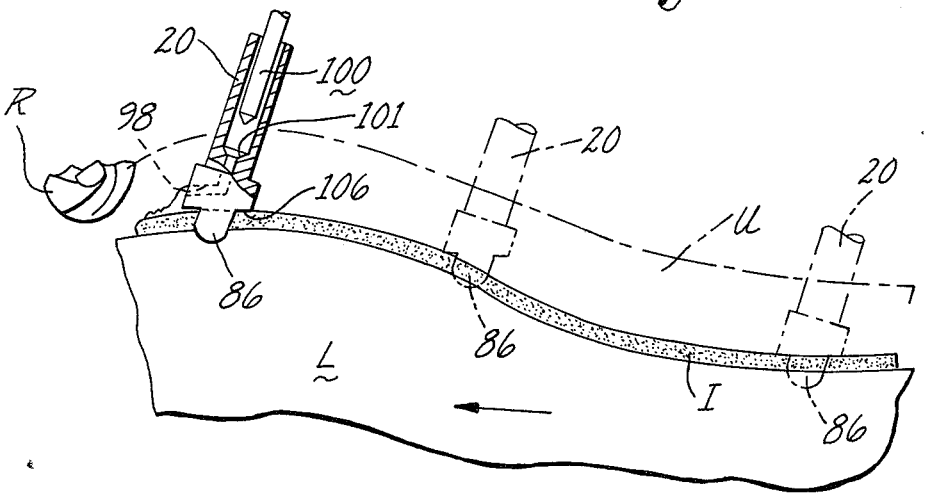
FIG. 4 is a detail view, as seen from the side of one of the nozzle members, showing the relationship between the operative end portion of the nozzle member and the shoe bottom during operation of the machine.

The shoe supporting means comprises a jack post 10, only a portion of which is shown in FIG. 1, which carries a last pin 8 upstanding from a block 9 supported (with capacity for some movement extending transversely in the machine) upon a head portion of the jack post 10. The jack post 10 is mounted for swinging movement about a transverse axis upon a carriage and also for rising and falling movements relatively to the carriage, the carriage not being shown. The carriage is movable, in a direction extending lengthwise of a shoe assembly mounted upon the shoe supporting means, relatively to an arrangement of lasting rolls, one of which is shown in FIG. 4, and to an arrangement of nozzle members having adhesive applying means. The machine also has means for swinging the jack post about said transversely extending axis and for raising and lowering the jack post, to move the jack post from a shoe loading position to an operative position in which a heel seat portion of the shoe is located against a hold-down member 12 carried by the carriage.

The adhesive applying means of the illustrative machine comprises a pair of nozzle members 20 each for operating at opposite sides of the shoe assembly and extending from lower end portions of a pair of nozzle carriers 22. Upper end portions of each of the nozzle carriers 22 are pivoted on studs 24 extending from forward end portions of a pair of nozzle supporting arms 26, only one being shown. The nozzle supporting arms 26 are substantially L-shaped, as shown in FIG. 1. The nozzle supporting arms 26 are pivoted for swinging movements about a cross shaft 28 which is carried by frame portions of the machine.

Pivotal movement of the nozzle supporting arms 26 about the cross shaft 28 permits the nozzle members 20 to rise and fall heightwise with respect to the general plane of the bottom of a shoe carried by the shoe support, while pivotal movement of the nozzle carriers 22 about the axes of the studs 24 permits the nozzle members 20 to move widthwise with respect to the shoe bottom. Because of the remoteness of the nozzle members 20 from the axis of the cross shaft 28, the rising and falling movements of the outlet end portions of the nozzle members 20 take place on generally linear heightwise paths. Similarly, because of the length of the nozzle carriers 22, pivotal movement about the pivot studs 24 also permits generally linear widthwise movement of the outlet end portions of the nozzle members 20. The arrangement just described also permits each of the nozzle members 20 to be suspended above the shoe assembly being operated upon and moved between the retracted, inoperative positions and operative positions without interfering with other operative portions of the machine.

Each nozzle supporting arm 26 is acted upon by a first piston and cylinder arrangement 30 for imparting rising and falling movements of the nozzle members 20, and for largely counterbalancing the weight of the nozzle members 20 and associated parts while the nozzle members 20 are operating to apply adhesive along the marginal portions of the shoe bottom. Each piston and cylinder arrangement 30 (one for each arm 26) comprises a cylinder 32 as shown in FIG. 1, supported by a frame portion 34 of the machine. The cylinder 32 contains a slidably mounted piston 36 from which extends a piston rod 38. A rearward end of the piston rod 38 bears against a hardened plate 40 on the associated nozzle supporting arm 26.

Figure 3:
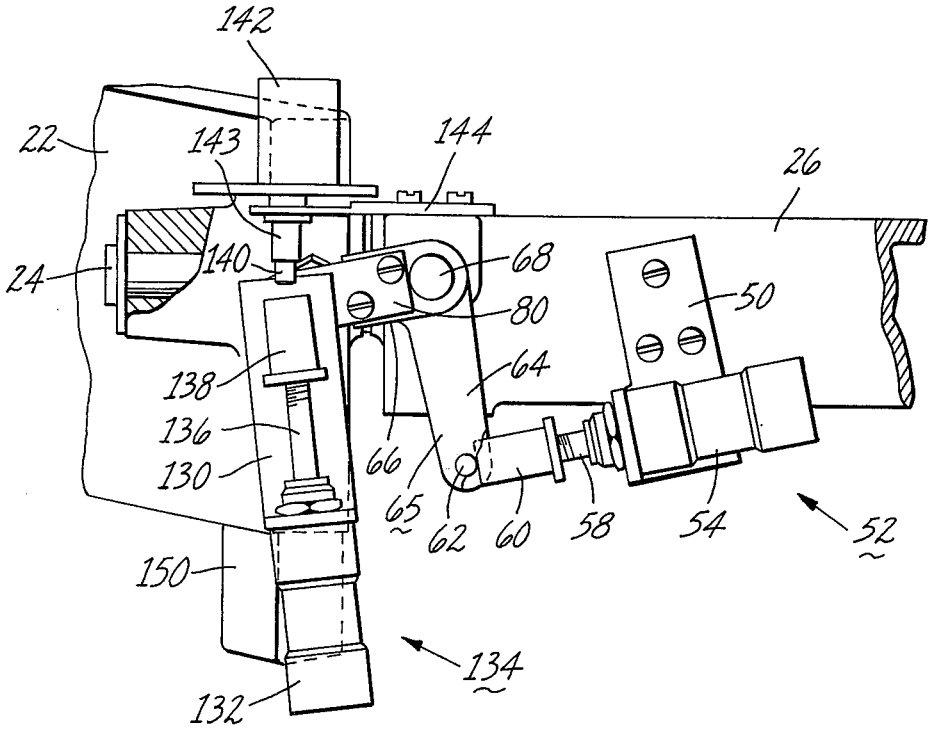
FIG. 3 is a detail view, in plan, of parts seen in FIG. 1.

Each nozzle supporting arm 26 has an upstanding bracket 50, as shown in FIGS. 1 and 3, on which a second piston and cylinder arrangement 52 is mounted for imparting movements to the nozzle member 20 outwardly widthwise of the shoe assembly. The piston and cylinder 52 comprises a cylinder 54 in which is slidably mounted a piston (not shown) from which extends a piston rod 58. A head portion 60 of the piston rod 58 is arranged to abut against a pin 62 extending between lugs of a bifurcated outer end portion of one arm 64 of a bell crank lever 65. A second arm 66 which extends forwardly, is shown in FIGS. 1 and 3. The bell crank lever arms, 64, 66, are pivoted on studs 68 upstanding from each of the nozzle supporting arms 26.

Figure 2:
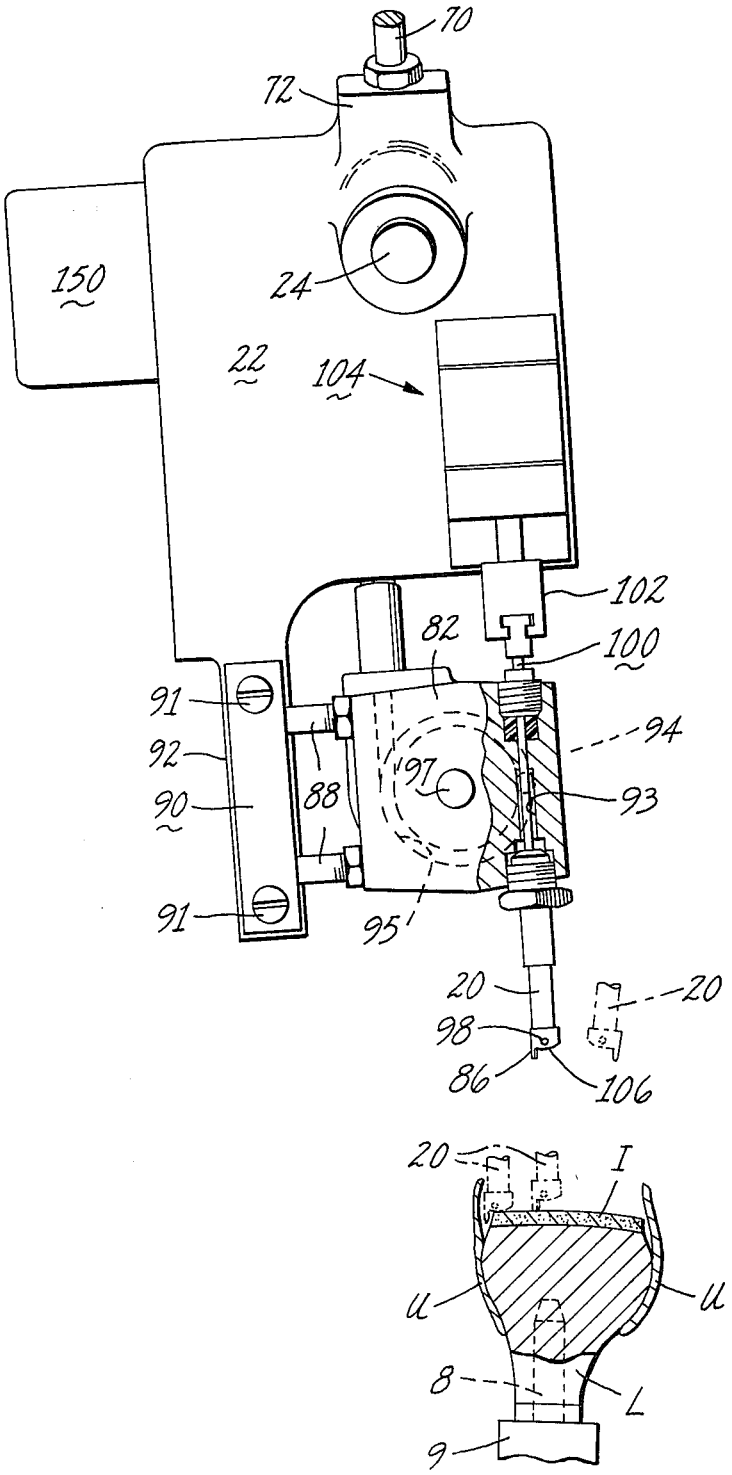
FIG. 2 is a view looking in the direction of the lines II II in FIG. 1 but showing the nozzle located on the left-hand side.

Each of the nozzle carriers 22 has a pin 70 extending from a boss 72, as shown in FIGS. 1 and 2, and is coupled with the forwardly extending arm 66 of the associated bell crank lever 65 by a connecting pin 78 slidable in the arm 66 supported within a bracket 80. When air under pressure is admitted to rearward end portions of the cylinders 54, each of the piston rods 58 are moved forwardly to cause the head portions 60 to abut against the pins 62 and swing the bell crank lever arms 64, 66, in directions to swing the nozzle carriers 22 in such directions as to move the outlet end portions of the nozzle members 20 outwardly away from each other. Air pressure applied to the opposite ends of the cylinders 54 will urge the head portions 60 away from the pins 62 so that frictional forces in the piston and cylinder arrangement 52 do not impose additional loads on each of the nozzle members 20 during their shoe bottom edge following movements.

Each nozzle carrier 22 is provided with a counterweight 150, as shown in FIG. 2, for biasing their respective nozzle members 22 inwardly, about pivot studs 24, during the adhesive applying operation. The counterweight 150 being on the left, as shown in FIG. 2, would cause a counterclockwise direction of rotation by nozzle 20 about stud 24. This direction is also toward the center of the shoe, as shown in the drawing. When pressurized air is supplied to the forward end portions of the cylinders 32 the pistons 36 will travel rearwardly (as seen in FIG. 1) to swing the nozzle supporting arms 26 clockwise about the cross shaft 28 (as seen in FIG.

1) to raise the nozzle members 20 from their operative positions to inoperative positions. When it is desired to move the nozzle members 20 to operative positions the air pressure acting in the cylinders 32 is reduced sufficiently to allow the weight of the parts to swing the nozzle supporting arms 26 in a counterclockwise direction about the cross shaft 28. The pressure of air admitted to the cylinders 32 under this condition will be sufficient to counterbalance the greater part of the weight of the nozzle members 20 and the associated parts so that the outlet end portions of each of the nozzle members 20 bear little pressure against the shoe bottom.

Each pin 70 disposed on the nozzle carriers 22 is received within a generally oval shaped bore 74, as shown in FIG. 1. The bore 74 extends transversely through a central portion 76 of a connecting pin 78. The connecting pin 78 is rotatably mounted (with capacity for endwise movement) in aligned bores in the associated arm 66 and in an L-shaped bracket 80 which is secured to that arm 66, again as shown in FIG. 1. This arrangement permits a floating connection between the arm 66 and the associated pin 70 to allow for the swinging movements of the arms 66 and 64 in one plane and the swinging movement of the pin 70 in another plane substantially at right angles thereto.

Each nozzle member 20 is generally tubular in form, an upper end of the nozzle 20 being secured in a nozzle block 82 and a lower end being provided with a shoe bottom margin engaging surface 106 and a guide portion 86 depending at an outer side of the surface 106. Each nozzle block 82 is supported by a pair of pins 88 extending from a block 90 of heat insulating material secured, by screws 91, to a depending portion 92 of the associated nozzle carrier 22. The nozzle block 82 is heated in order to maintain a thermoplastic adhesive fed to the nozzle member 20 in molten condition. Each nozzle block 82 provides a melting device 94 through which extends a spirally disposed passageway 95 leading from an inlet connection 96, shown in FIG. 1, to a passageway 93, shown in FIG. 2, through the nozzle block 82 to the nozzle member 20. The melting device 94 is provided with an electrically heated cartridge 97, as shown in FIG. 2, for maintaining the melting device at such a temperature that adhesive in the form of rod fed by any convenient means into the inlet connection and may be melted and, as further solid rod is fed into the inlet connection, molten adhesive is extruded through an outlet opening 98 provided in the nozzle member 20. Liquid adhesive, however, may be substituted for the thermoplastic solid type of adhesive.

To avoid drooling of adhesive from each of the nozzle members 20 between successive cycles of operation of the machine, there is provided, for each nozzle member 20, a needle valve 100, as shown in FIG. 2, which extends through a bore in the associated nozzle block 82 to seat against a seat 101, as shown in FIG. 4, in the nozzle member 20 at a locality close to the outlet opening 98. Each needle valve 100 is connected with a plunger 102 of a piston and cylinder device 104 which acts to retract the needle valve 100 from its seat 101 during the time when it is desired to apply adhesive to the margin of the bottom of the shoe. Each piston and cylinder device 104 is secured to the associated nozzle carrier 22.

A second bracket 130, as shown in FIGS. 1 and 3, is secured to each bracket 80 which supports a cylinder 132 of a third piston and cylinder arrangement 134. A piston rod 136 of piston and cylinder arrangement 134 extends widthwise of the machine as shown in FIG. 3. A head portion 138 is adjustably threaded upon the piston rod 136, which is arranged to abut against a plunger 140 of a valve 142 secured to a plate 144. The plate 144 is upstanding from, and secured to, the associated supporting arm 26. The piston and cylinder arrangement 134 and its associated parts provide stop means, as detailed below, for adjustably limiting the widthwise separating movement of the nozzle members 20 under the action of the piston and cylinder arrangements 52.

During the cycle of operations of the present invention, a shoe assembly, shown in FIG. 4, comprising an upper U and an insole I mounted on a last L will be placed upon the jack post 10 with the last pin 8 engaged in the usual thimble hole of the last L on which the shoe assembly is mounted while the jack post 10 is in its loading position, as shown in FIG. 1. The jack post 10 will then be swung heelwardly and raised to position the heel seat portion of the insole I against the hold-down member 12 by means fully disclosed in said copending application. A toe engaging member, not shown, by engagement with the toe end portion of the shoe assembly, automatically sets the position of a stop rod, not shown, relative to the carriage in a position in accordance with the length of the shoe to be operated upon. The shoe clamping means comprising heel band and side clamping assemblies, indicated by the letter H in FIG. 1, will be applied to the shoe assembly to hold it firmly in position with the shank portion at least approximately centralized widthwise in the machine. A toe pad 172 supported by the shoe carrier will also be raised into shoe supporting position. The carriage for the shoe supporting means is moved rearwardly and forwardly by means of a pneumatic piston and cylinder arrangement under the control of a hydraulic dash-pot arrangement, not shown. When the jack post 10 is in its loading position the carriage occupies a loading position which is intermediate its fully forward and fully rearward positions. At this time the nozzle members 20 are in their raised, inoperative positions, the pistons 36 being urged to the right, as seen in FIG. 1, by air pressure applied in the cylinders 32. The nozzle members 20 are also held in their innermost positions, closely adjacent to each other, as a result of the action of the counterweights 150 urging the nozzle carriers 22 in opposite directions about the pivot studs 24. When the shoe supporting carriage is in its loading position, the nozzle members 20 are located above a portion of the insole in the relatively narrow shank region. At this time, a signal is developed in the control circuit of the machine which brings about a reduction in the pressure of air supplied to the cylinders 32 to allow the nozzle supporting arms 26 to swing downwardly to cause the nozzle members 20 to approach the shoe bottom or insole I. Simultaneously, air under pressure is applied to the rearward end portions of the cylinders 52 to cause the piston rods 58 to outstroke and, through the action of the levers 64, 66 and associated parts, to swing the nozzle carrier outwardly against the action of the counterweights 150. At this time, air under pressure is applied to the cylinders 132 to extend the piston rods 136 into the positions shown in FIG. 3. Outward swinging movement of the nozzle carriers 22 under the action of the piston and cylinder arrangements 134 is limited by engagement of the head portions 138 with sleeves 143 in which the plungers 140 of the valves 142 slide. As the head portions 138 move into engagement with the sleeves 143, the plungers 140 are actuated to operate the valves 142. This removes the air pressure applied to the cylinders 54 to allow springs therein to withdraw the piston rods 58 and hence to remove the head portions 60 from abutting relationship with the pins 62, so that the counterweights 150 may again be effective to bias the nozzle members 20 inwardly toward the shoe bottom edges. The operation of the valves 142 also acts to remove air pressure supplied to the cylinders 132.

Engagement of the head portions 138 with the sleeves 143 is arranged to arrest outward movement of the nozzle members 20 when the guide portions 86 have moved outwardly sufficiently far to clear the edges of the shoe bottom in the comparatively narrow shank region. As may be seen in FIG. 2, shoe bottom margin engaging surfaces 106 of the nozzle members 20 are arranged to extend widthwise of the machine to such an extent, conveniently some 8 mm., that the stop means provided by the head portions 138 and the sleeves 143 does not require adjustment to ensure that, when the outward movement of the nozzle members 20 is arrested, the guide portions 86 are beyond the opposite edges of the insole but the insole shoe bottom engaging surfaces 106 extend, at least in part, over marginal portions of the shoe bottom so as to prevent the nozzle members 20 dropping completely off the edges of the insole over at least a considerable range of sizes of insole. With the guide portions 86 over the opposite edges of the insole, the nozzle members 20 rest with their insole or shoe bottom engaging surfaces 106 in contact with marginal portions of the insole and the guide portions 86 are biased inwardly, by action of the counterweights 150, into engagement with the opposite edges of the insole.

The air pressure admitted to the cylinders 32 is sufficient to counterbalance the major portion of the weight of the nozzle members 20 and their associated parts so that the nozzle members 20 rest with but light pressure upon the insole I. Similarly, the counterweights 150 are selected so that the guide portions 86 rest only lightly against the edges of the shoe bottom so as not to be likely to break those edges down even in relatively thin portions of the insole I.

The nozzles 20 having been moved into proper engagement with the insole I, the carriage is then moved rearwardly to a position determined by engagement of a rear end portion of the previously mentioned stop rod with an abutment member of the machine. During such movement of the carriage, the shoe bottom is moved lengthwise relative to the nozzle members 20 while the guide portions 86 are maintained in engagement with the opposite edges of the insole. The exhaustion of air from the cylinders 132 renders the stop means provided by the head portions 138 and the sleeves 143 ineffective so that the nozzle members may move outwardly to the desired extent as the wider portions of the insole I are traversed. When rearward or heelward movement of the carriage is arrested, the shoe assembly will be positioned in the desired position for a typical arrangement of lasting rolls, as indicated by R in FIG. 4, to commence the side lasting operation, adjacent the previously lasted toe portion.

At the time when rearward movement of the carriage is arrested, a valve device in the control circuit arrangement is actuated to initiate the feeding of adhesive through outlet openings 98 of the nozzle members as shown in FIGS. 2 and 4. The openings are positioned to permit adhesive to flow under the lasting marginal portions of the upper U as they curl over the insole I toward the previously lasted toe portion. The lasting rolls R are then lowered into operative positions in engagement with the lasting marginal portions of the insole, and forward movement of the carriage is initiated to carry the shoe assembly forwardly to cause the nozzle members 20 to extrude adhesive along the marginal portions of the insole I as they are maintained with the guide portions 86 in engagement with the opposite edges of the insole I, and the lasting rolls R, to wipe marginal portions of the upper U inwardly across the applied adhesive. The lasting operation thus progresses continuously and simultaneously along opposite side portions of the shoe assembly from the previously lasted toe portion to a region in the vicinity of the breast line. Movement of the carriage is then arrested and the nozzle members 20 and the lasting rolls R are returned to their inoperative positions. Air under pressure is then readmitted to the cylinders 132 to reset the stop means provided by the head portions 138 of the piston rods 136 and the sleeves 143.

The adhesive applying operation may be terminated by any known manner such as a signal derived from the carriage reaching a predetermined position. This signal also causes the upward withdrawal of the nozzle members 20, resulting from an increase in pressure of the air supplied to the cylinders 32, the nozzle members 20 being urged inwardly to their initial positions by the action of the counterweights 150. The signal also acts to terminate the feeding of adhesive to the nozzle members 20 and the closing of the needle valves 100. The signal also automatically causes the raising of the lasting rolls R at the end of the lasting operation, and the shoe supporting jack post 10 being swung to its initial loading position, while the carriage is moved rearwardly or heelwardly to its loading position.

The outlet openings 98 of the nozzle members are directed toward the front of the machine so that they are trailing in the sense of the direction of movement of the shoe assembly past the nozzle members 20, the shoe assembly moving in the direction of the arrow shown in FIG. 4. As seen in FIG. 4, the toe end of the shoe points in the direction of movement and the forepart of the bottom of the last L is often inclined (to an extent depending on the style of shoe and heel height) to the horizontal. The insole engaging surface 106 of the nozzle members 20 is therefore also inclined to the horizontal at a considerable angle so as to enable the nozzle members 20 to seat on forepart portions of the shoe bottoms of various styles of shoe assembly and maintain the outlet openings 98 of the nozzle members 20 in close proximity to the insoles I. This inclination of the insole engaging surfaces 106 also tends to ensure that when the nozzle members 20, during their outward movement, reach the opposite edge portions of the insole I, the guide portions 86 drop over the opposite edges of the insole I and may be moved into contact therewith. In FIG. 4 there is also shown in chain dotted lines the positions which a nozzle member 20 occupies with respect to the insole I at progressively later stages in the movement of the shoe assembly past the nozzle member 20.

It is to be understood that the foregoing embodiment is stated as descriptive and exemplary only, and not to be interpreted as limiting the scope of the invention.

We claim as our invention:

1. A machine for manufacturing shoes, said machine having a shoe support, and lasting elements which are relatively movable generally lengthwise with respect to a shoe on said support, for securing a shoe upper to a shoe bottom, including:

means for applying adhesive progressively to the margin of said shoe bottom, said means comprising at least one nozzle through which adhesive is extruded;

means for moving said nozzle from an inoperative position outwardly widthwise of the shoe to a location limited by an adjustable stop means, said nozzle having a shoe bottom engaging portion and a heightwise extending guide portion adapted to engage the peripheral edge of the shoe bottom;

means for biasing said nozzle inwardly toward the middle of said shoe bottom to maintain engagement between said guide portion of said nozzle and the edge of said shoe bottom during the relative movement therebetween, said stop means being ineffective during said relative movement to permit said guide portion to follow the peripheral contour of the shoe bottom.

2. A machine for manufacturing shoes, as recited in claim 1, wherein said biasing means comprises a counterweight arranged so as to cause a pivoting about a pivot arrangement wherein said nozzle and associated guide portion is maintained in engagement with said edge of said shoe bottom.

3. A machine for manufacturing shoes as recited in claim 1, wherein said means for applying adhesive comprises two generally widthwise adjacent nozzles, each providing adhesive to its respective side of a shoe bottom simultaneously.

4. A machine for manufacturing shoes, as recited in claim 1, wherein said means for moving said nozzle from the inoperative position into a shoe bottom engaging position comprises an arrangement of first and second piston and cylinder devices.

5. A machine for manufacturing shoes as recited in claim 4, wherein a sensing device is associated with said adjustable stop means, comprising a valve arrangement for rendering said second piston and cylinder device ineffective so that each of said nozzle members may be biased inwardly by said counterweights to urge said guide portions of said nozzle members into engagement with said edge portions of said shoe bottom.

6. A machine for manufacturing shoes as recited in claim 5, wherein said adjustable stop means comprises a third piston and cylinder device including a retractably biased piston rod having an extendably adjustable head portion thereon, said head portion coming into contact with said valve when said nozzles are moved to a predetermined limit, said contact with said valve causing a reduction in pressure in said second piston and cylinder arrangement to arrest further extension thereof.

7. A machine for manufacturing shoes as recited in claim 5, wherein said valve also causes a reduction of pressure in said third piston and cylinder arrangement, causing retraction thereof to permit slight movement of said nozzle as it engages the edges of said shoe bottom.

* * * * *